United States Patent [19]

Bensen

[11] 3,931,926

[45] Jan. 13, 1976

[54] LATCHING MEANS

[76] Inventor: Richard E. Bensen, 18 Springfield Ave., Apt. 3G, Cranford, N.J. 07016

[22] Filed: Apr. 18, 1974

[21] Appl. No.: 461,961

[52] U.S. Cl. ..... 229/45 R; 229/DIG. .008

[51] Int. Cl.[2] ..... B65D 45/00

[58] Field of Search ..... 224/45 H, 49; 229/DIG. .008, 84 R, 45 R; 24/201 S, 201 A

[56] References Cited

UNITED STATES PATENTS

| | | | |
|---|---|---|---|
| 880,223 | 2/1908 | Kahn | 229/84 R |
| 2,075,259 | 3/1937 | Battjes | 229/DIG. .008 |
| 2,128,509 | 8/1938 | Swope | 229/45 R |
| 2,306,328 | 12/1942 | Biberthaler | 229/45 R |
| 2,809,777 | 10/1957 | Davidson | 229/45 R |
| 2,834,531 | 5/1958 | Strable | 229/45 R |
| 2,925,213 | 2/1960 | Zukoski | 229/45 R |
| 3,288,349 | 11/1966 | Palmer et al. | 229/45 R |
| 3,458,113 | 7/1969 | Swartzbaugh | 229/45 R |

FOREIGN PATENTS OR APPLICATIONS

| | | | |
|---|---|---|---|
| 16,253 | 7/1908 | United Kingdom | 229/84 R |

*Primary Examiner*—Robert J. Spar
*Assistant Examiner*—Kenneth Noland
*Attorney, Agent, or Firm*—Jacob Trachtman

[57] ABSTRACT

A latching means for securing together a pair of members comprising a first member and a second member, said first member having a first pair of elements while said second member has a second pair of elements, each of said elements having first and second sides, each of said first elements being positionable with its first side opposite to the first side of a respective one of said second elements for assuming its disengaged condition and alternatively with its second side opposite to the second side of its respective second element to assume its engaged condition, said first elements being spaced apart and extending in the directions toward each other while the second elements extend in the directions away from each other, at least one of said first elements having a hinged portion while at least one of said second elements has a hinged portion which is positioned opposite to said first element with the hinged portion, said first and second elements being movable with respect to each other and by actuation of the hinged portions of said elements being positionable to have the second sides of said elements opposite to each other to place the latching means in its engaged condition.

29 Claims, 14 Drawing Figures

LATCHING MEANS

Figure 1:
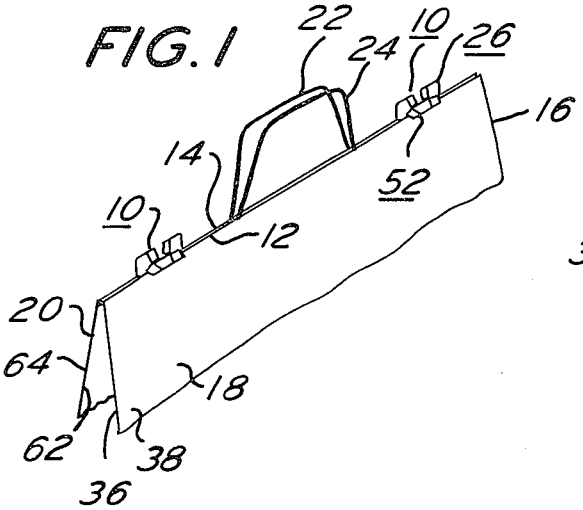

The invention relates to a latching means for securing together a pair of members and more particularly to a latching means which is readily detachable and firmly secures together a pair of members in an edge to edge hinged relationship.

Heretofore, latching means have been provided which have utilized a number of components for securing together bodies in a fixed or hinged relationship. Such devices have been relatively complex and expensive, or have not provided a firm securing means.

It is therefore a principal object of the invention to provide a new and improved latching means which will firmly secure together two bodies in an edge to edge relationship in any desired angular relationship.

Another object of the invention is to provide a new latching means which will allow a pair of bodies to be readily secured together in a hinged relationship.

Another object of the invention is to provide a new and improved latching means which may readily be manipulated for securing one body to another.

Another object of the invention is to provide a new and improved latching means which may be made integral with a sheet of material for readily and firmly securing together a pair of sheets in a hinged or fixed relationship.

Another object of the invention is to provide a new and improved latching means which may be inexpensively produced from various flexible or non-flexible materials and provides great utility and serviceability at low cost.

The above objects of the invention as well as many others are achieved by providing a latching means for securing together a pair of members comprising a first member and a second member, the first member having a first pair of elements while the second member has a second pair of elements. Each of the elements is provided with first and second sides and each of the first elements is positionable with its first side opposite to the first side of a respective one of the second elements for assuming the disengaged condition for the latching means. Alternatively each of the first elements is positionable with its second side opposite to the second side of its respective second element to assume the engaged condition. The first elements are spaced apart and each extend in a direction toward the other, while each of the second elements extend in a direction away from the other. At least one of the first elements has a hinged portion and at least one of the second elements has a hinged portion which is positioned opposite to the first element with the hinged portion. The first and second elements are movable with respect to each other and by actuation of the elements with the hinged portion, the second sides of the elements are positionable opposite to each other for placing the latching means in its engaged condition.

The first and second members are provided with opposing end edges from which the first and second elements project. The first and second elements are L-shaped and each of the first elements has a portion extending towards its other element in a direction along the edge of its body. Each of the second elements has a portion extending away from its other element in a direction along the edge of its body. In another form, a pair of second L-shaped elements is provided by a common upstanding portion projecting from the edge of its member and a pair of hinged portions on opposite sides of the upstanding portion extending away from each other in the direction along the edge of its member providing a T-shaped configuration. The pairs of first and second elements may also be hingedly secured along the edge of the member from which it projects for movement about an axis which is in the direction along the edge of its member. The members may comprise sheets and the elements may be integral with their respective sheets and composed of a flexible plastic material having score lines thereon, with the hinges of the elements and their hinged portions being provided along the score lines in the plastic material.

Figure 2:
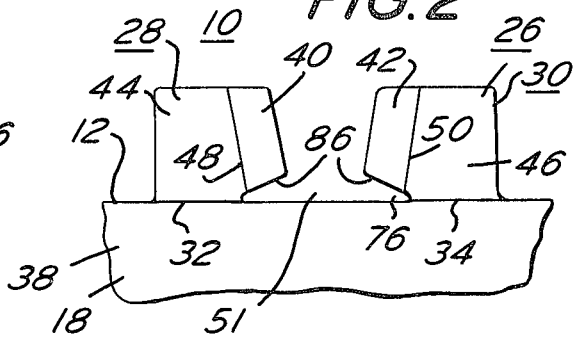
Figure 3:
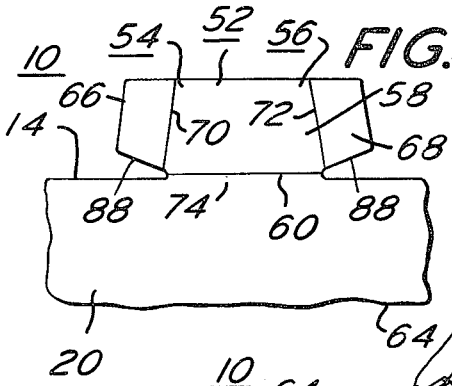
Figure 4:
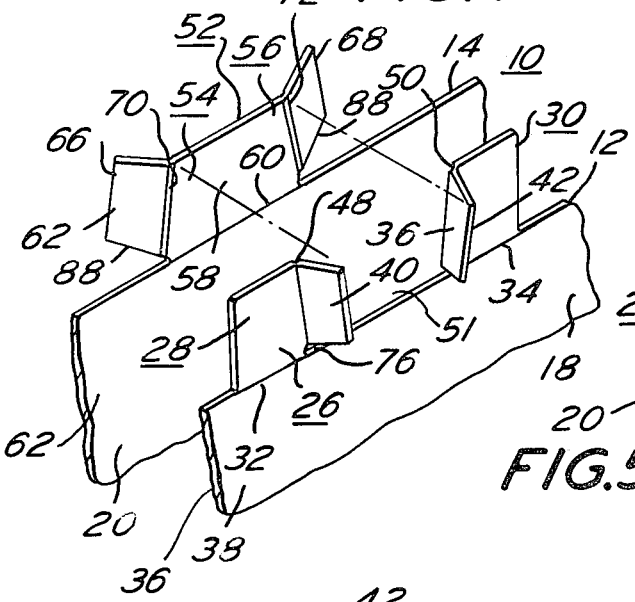
Figure 5:
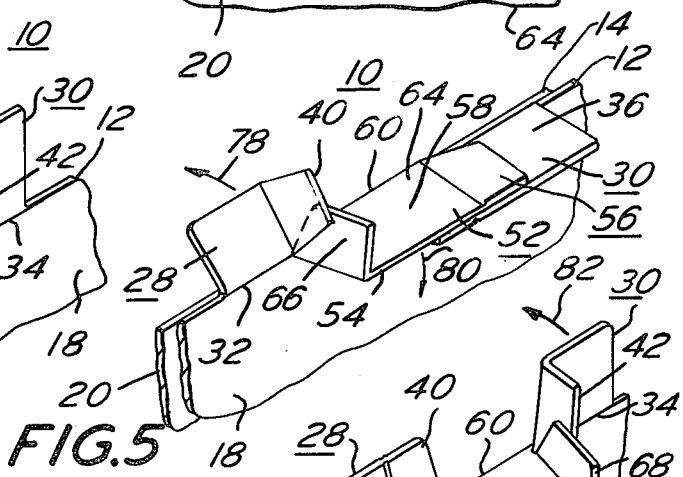
Figure 6:
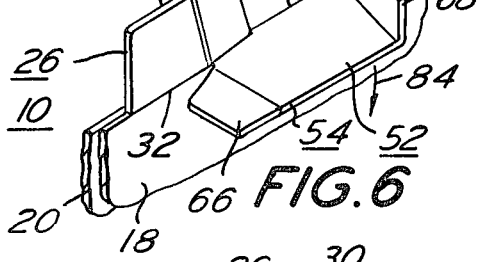
Figure 7:
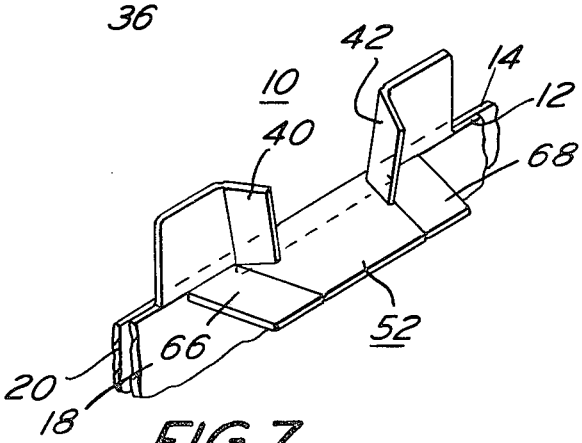

The foregoing and other objects of the invention will become more apparent as the following detailed description of the invention is read in conjunction with the drawings, in which:

FIG. 1 is a front perspective view of the top portion of a bag or container having latching means embodying the invention, FIG. 2 is an enlarged fragmentary front elevational view illustrating a first portion of the latching means shown in FIG. 1, FIG. 3 is an enlarged fragmentary front elevational view of a second portion of the latching means shown in FIG. 1, FIG. 4 is a front perspective view of the latching means shown in FIG. 1 with its portions in their disengaged condition, FIGS. 5, 6 and 7 are front perspective views which illustrate the steps for placing the latching means of FIG. 4 in its engaged condition.

Figure 8:
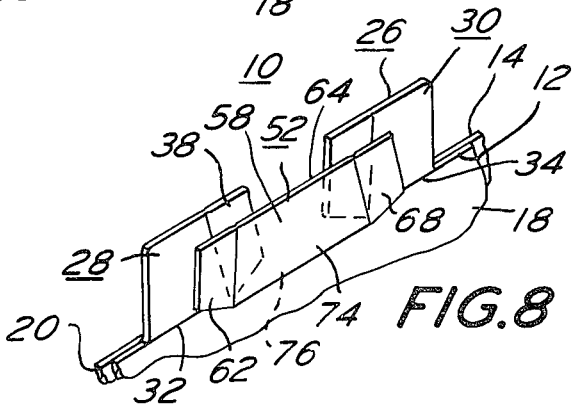
Figure 9:
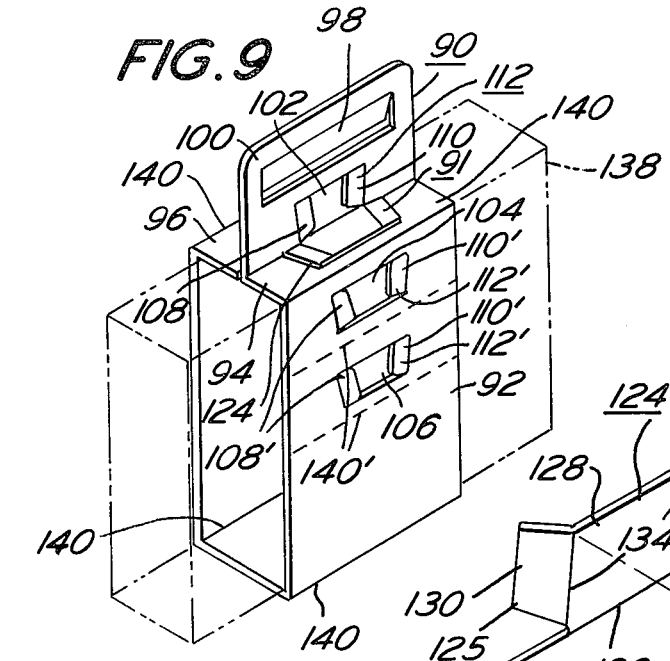
Figure 14:
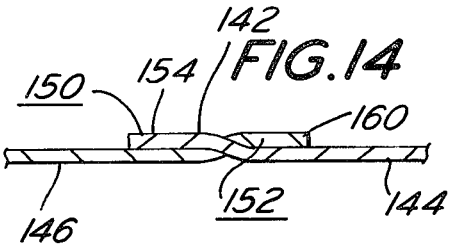
Figure 10:
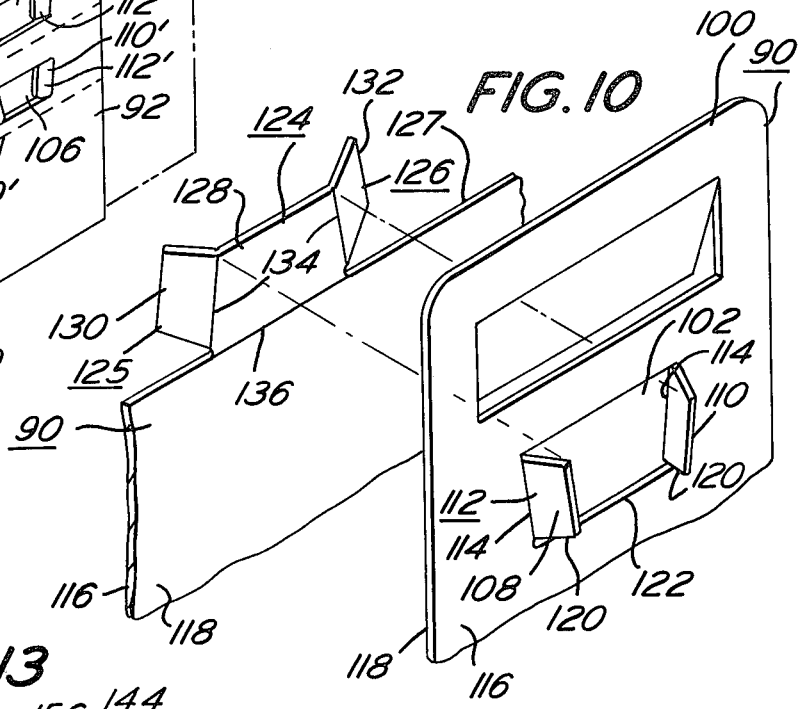
Figure 13:
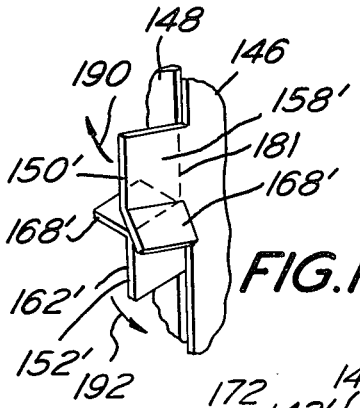
Figure 11:
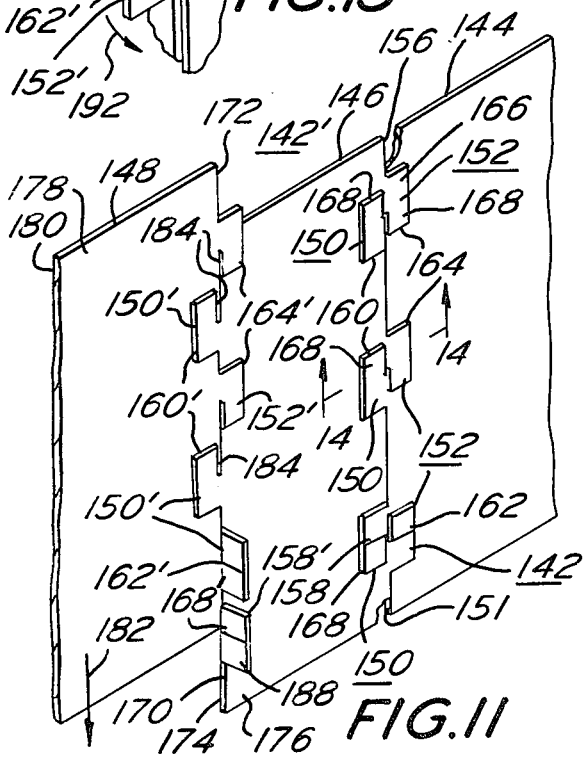
Figure 12:
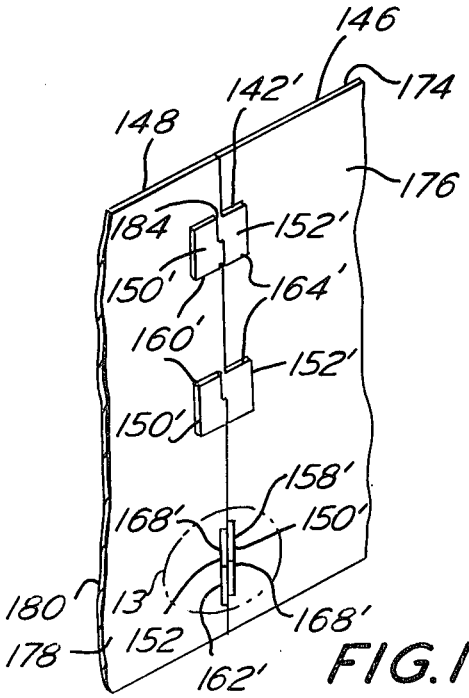

FIG. 8 is a front perspective view illustrating the latching means of FIG. 4 in its fully engaged condition, FIG. 9 is a front perspective view of an adjustable carrying band illustrating another form of the latching means embodying the invention, FIG. 10 is an enlarged perspective view with portions broken away of the latching means shown in FIG. 9 in its disengaged condition, FIG. 11 is a front perspective view illustrating another form of latching means comprising a plurality of passive and active elements embodying the invention, FIG. 12 is a front perspective view of the left hand portion of FIG. 11 illustrating the process of engaging a pair of active elements of the latching means, FIG. 13 is an enlarged side perspective view of the active elements of the latching means shown in FIG. 12, and FIG. 14 is a sectional view of a pair of engaged passive elements of the locking means taken on line 14—14 of FIG. 11.

Like reference numerals designate like parts throughout the several views.

FIGS. 1 to 8 inclusive illustrate a latching means 10 which embodies the invention. The latching means 10 may be utilized for securing together a pair of bodies. As illustrated by FIG. 1, a pair of latching means 10 secure together the upper opposing edges 12 and 14 of a bag or container 16. The latching means 10, however, may be utilized in connection with many other devices for firmly securing together members in a fixed or hinged relationship. In the illustration of FIG. 1, the container 16 is provided with sides 18 and 20 which may be made of sheets of flexible or rigid material which are secured together along the top edges 12, 14 and readily disengaged for opening and providing access to the bag or container 16. In the form illustrated, the sides 18 and 20 are formed of sheets of a plastic material such as polypropylene which is preferable for its durable and flexible qualities. A latching means 10 is provided at each end of the bag 16, while a handle is provided by the loops 22, 24 which are secured with each side 18, 20 intermediate the latching means 10.

The first portion of the latching means 10 is provided by a pair of elements 26 comprising L-shaped elements 28 and 30 which project upwardly from the edge 12 of the sheet 18. The elements 28 and 30 are secured with the sheet 18 by any of the well known manners including use of flexible tapes or use of actual pin hinges. It is preferable, however, that the elements 28 and 30 be made integral with and of the same plastic material of which the member 18 is composed. The plastic material is provided with score lines 32 and 34 on each of its sides 36 and 38 of the plastic sheet along which a hinge is provided between the sheet 18 and the elements 28 and 30.

The elements 28 and 30 are each provided with a portion 40, 42 which extends toward the other in a direction along the edge 12 of the sheet 18. The portions 40, 42 are hinged with the upstanding portion 44, 46 of its element 28, 30. Thus the extending portion 40 is hinged along the score lines 48 on the opposite sides 36, 38 of its element 28, while the extending portion 42 is hinged along score lines 50 on the opposite sides 36, 38 of its element 30. The lines 48, 50 which provide the axes about which the portions 40, 42 move, are substantially perpendicular to the edge 12 of the sheet 18 and as illustrated may be inclined away from each other in the direction away from the edge 12. The space 51 formed between the elements 28 and 30 has a substantially inverted T-shaped configuration with the horizontal portion of the T along the edge 12 of the sheet extending below the hinged portions 40 and 42 of the elements 28 and 30.

The second portion of the latching means 10 includes a pair of elements 52 which projects upwardly from the edge 14 of the sheet 20 and may be integral with the sheet 20 and made of the same material such as the preferred polypropylene plastic material. The pair of elements 52 essentially comprises the L-shaped elements 54 and 56 which may be arranged in a back to back relationship to provide a T-shaped configuration. The elements 54 and 56, thus, comprise an upstanding central portion 58 which projects from the edge 14 and is hingedly secured with the sheet 20 along a pair of score lines 60 on the opposite sides 62, 64 of the sheet. The elements 54, 56 are each provided with a respective hinged portion 66, 68 which extend in directions opposite to each other along the edge 14 of the sheet 20. The element 54 is provided with score lines 70 on opposite sides 62, 64 along which the portion 66 is hingedly secured with the central portion 58, while the score lines 72 on opposite sides 62, 64 of the element 56 provide a hinge connection for the extending portion 68. The score lines 70 and 72 provide axes about which the hinged portions 66 and 68 move which are substantially perpendicular to the edge 14 of the sheet 20, and may be inclined toward each other in the upward direction away from the edge 14 of the sheet 20 as illustrated.

Refer to FIG. 4 which illustrates the latching means 10 in its disengaged condition. For the purpose of engaging the latching means 10, the sheets 18 and 20 are positioned proximate to each other with their edges 12 and 14 opposite to each other. The elements 28 and 30 which project from the sheet 18 are respectively positioned opposite the elements 54 and 56 which project from the sheet 20. In their disengaged condition, the sides 36 and 62 respectively of the pairs of elements 26 and 52 are proximate or opposite to each other as shown in FIG. 4. To place the latching means 10 in its engaged condition, the upstanding portion 58 of the pair of elements 52 is received in the opening 51 between the pair of elements 26. During such engagement the inclined axes 48, 50 of the pair of elements 26 and the oppositely inclined axes 70, 72 of the pair of elements 52 assist in pivoting the hinged portions of the elements and providing clearance for the passage of elements past each other to overlie each other on opposite sides as illustrated in FIG. 8. Such engagement action is also assisted by the hinged connection of the pair of elements 26 with the sheet 18 along the score lines 32 and 34 which extend along the edge 12 and the hinged connection of the pair of elements 52 with the sheet 20 along the score lines 60 which also extends in a direction along the edge 40 of the sheet 20.

When the latching means 10 is in its engaged condition, as illustrated in FIG. 8, the neck portion 74 of the pair of elements 52 where it joins the sheet 20 extends through the widened portion 76 of the T-shaped opening 51 along the edge 12 between the pair of element 26 with the central portion 58 of the pair of elements 52 extending upwardly therefrom. In this relationship, the sides 38 and 64 of the pairs of elements 26 and 52 are positioned opposite to each other, and the sheets 18 and 20 are hingedly secured together with their edges 12 and 14 in side by side opposing relationship. The sheets 18 and 20 are thus firmly secured against separation or relative movement except for the hinged or angular disposition permitted by the hinged action provided by the latching means.

For the purpose of clearly illustrating the manner in which the latching means 10 may easily be engaged, and in reverse action disengaged, refer to FIGS. 5, 6 and 7. FIG. 5 illustrates the manner in which after the sheets 18 and 20 are positioned proximate to each other in the arrangement shown in FIG. 4, the element 28 of the pair of elements 26 is moved about its hinge along the score line 32 in the counter clockwise direction illustrated by the arrow 78, while the pair of elements 52 are pivoted about its score line 60 in the clockwise direction illustrated by the arrow 80. The element 30 of the pair of elements 26 also rotates in the clockwise direction with the element 56 as illustrated. When the pairs of elements 26, 52 have been rotated sufficiently in opposite directions, the pivoted hinged portion 40 of the element 28 clears the pivoted portion 66 of the element 54. The hinged portions are after such clearance realigned, to extend along the respective edges of their bodies as illustrated in FIG. 6. The elements 28 and 54 are thus now in an engaged condition.

For the purpose of engaging the remaining elements 30 and 56, the element 30 is rotated about its hinge along the score line 34 in the counter clockwise direction as illustrated by the arrow 82 in FIG. 6, while the pair of elements 52 are rotated about their hinge along the score lines 60 in the opposite clockwise direction illustrated by the arrow 84. When sufficient relative rotation has been achieved, the hinged portion 42 of the element 30 clears the hinged portion 68 of the element 56, allowing the elements to return to align positions with their respective edges 12, 14 of their sheets 18, 20.

FIG. 7 illustrates the latching means 10 after the extending hinged portions 66, 68 of the pair of elements 52 have cleared the hinged portions 40, 42 of the pair of elements 26, and before the hinged portions 40, 42 have been aligned with the edge 12 of their sheet 18. After such alignment the latching means 10 assumes the relationship between the elements illustrated in FIG. 8, while allowing one sheet to pivot with respect to the other about an axis in a direction along the edges 12 and 14 of the sheets 18 and 20.

It is noted that the lower edges 86 on the extending portions 40, 42 of the pair of elements 26 extend in the upward direction towards each other, while the bottom edges 88 of the pair of elements 52 also inclined upwardly in a direction away from their central upstanding portion 58 (see FIGS. 2 and 3). The tapered configuration of the lower edges facilitates clearance of the hinged portions when the latching means is being engaged or disengaged. The latching means 10 may be disengaged by carrying out the operations illustrated and described above in reverse order. Thus the latching means 10 may be disengaged by actuating the pair of elements 52 in the opposite direction for removing it from the opening 51 between the element 26 by concurrent movement of the hinged portions, or by unlatching one pair of opposite elements at a time as illustrated in connection with FIGS. 5 and 6. The elements may also be utilized as passive and active pairs for engaging and disengaging the locking means 10 which will be described in greater detail in connection with the modified embodiment shown in FIGS. 11 to 14 inclusive.

Refer now to FIGS. 9 and 10 which disclose an adjustable securing band 90 including a latching means 91 emobdying the invention. The band 90 comprises a elongated strip of material 92 which is preferably made of a plastic material such as polypropylene, although any other suitable material may be utilized. The band 90 has ends 94 and 96 which are positioned proximate to each other when its latching means 91 is in its engaged condition as illustrated in FIG. 9. The end 94 of the band 90 may be provided with an opening 98 forming a carrying handle 100 at its top. Below the handle 100, the band 90 is provided with a plurality of openings 102, 104 and 106 spaced one below the other along the band 90. A pair of elements 108 and 110 extend into the opening 102 in directions toward each other to provide a pair of elements 112 of the latching means 91 corresponding to the pair of elements 26 of the latching means 10 illustrated in FIG. 2. The elements 108 and 110 are hingedly secured with the band 90 along score lines 114 on the front and back surfaces 116 and 118 of the band 80 (see FIG. 10). The hinged portions 108 and 110 are provided with bottom edges 120 which slope upwardly in the direction in which the elements project into the opening 102. This provides the opening 102 with an inverted T-shaped configuration when the portions 108, 110 are aligned with the bottom edge 122 of the opening 120 as shown in FIG. 9.

The openings 104, 106 are each provided with hinged portions 108′ and 110′ constituting a pair of elements 112′ similar to the elements 112. Although only three pairs of elements 112 and 112′ are illustrated, one or more of such pairs of elements may be utilized for providing the latching means 91.

The end 96 of the band 90 has a pair of elements 124 comprising elements 125, 126 projecting from the edge 127 provided by an upstanding central portion 128 and hinged portions 130, 132 similar to the pair of elements 52 of the latching means 10 illustrated in FIG. 3. The portions 130, 132 are respectively hinged along score lines 134 on each side 116, 118 of the band 90. The pair of elements 124 is also hingedly secured along score lines 136 provided on opposite sides 116, 118 of the band 90.

The adjustable band 90, for example, may be utilized by being secured about an object such as material 138 which is to be bound or carried. For this purpose, the pair of elements 124 is positioned proximate to one of the openings 102, 104, 106 and opposite to the respective elements 108, 110 or 108′, 110′ of the selected opening and engaged therewith in a manner similar to that described above in connection with the latching means 10. The upstanding portion 128 of the pair of elements 124 may then be moved into the opening such as opening 102, causing the hinged elements 130 and 132 to move back, while the hinged elements 108, 110 of the pair of elements 112 move in the forward direction as illustrated in FIG. 10. After the elements have passed and cleared each other, they may again assume their aligned positions as shown in FIG. 9, which illustrated latching means 91 in its engaged condition. The latching means may be disengaged by movement of the pairs of elements in the opposite direction until the elements are clear and the pair of elements 124 have been removed from the opening 102.

The pairs of elements 112 and 124 may also be engaged as illustrated previously in connection with the latching element 10, by moving one of the elements 130, 132 past its corresponding element 108 or 110 until it clears, after which the other element is moved past its corresponding element as illustrated in FIGS. 5 and 6. The latching means 91 may be disengaged in a similar manner by movements in the opposite directions.

The latching means 91 can be secured at the various locations along its length provided by the openings 102, 104 and 106 to adjust for the perimeter about the material 138 to be encompassed. The band 90 may also be folded along a plurality of lines 140 as illustrated to accommodate to the configuration of the material 138 or at other locations such as shown by the dashed lines 140′ to other shaped objects.

Refer now to FIGS. 11 to 14 which illustrate another form of latching means 142 which is a modified form of the latching means 10. The invention is illustrated by a plurality of sheets 144, 146 and 148 which are firmly secured together, edge to edge in a hinged relationship, similar to that of a Japanese screen.

The latching means 142 securing together the plates 144 and 146 has a first set of elements 150 which project from the end edge 151 of the plate 144 and a second set of elements 152 which project from the end edge 156 of the plate 146. The sets of elements 150 and 152 may be integral with and made of the same material as the plates 144 and 146. The set of elements 150 includes one active element 158 and one or more passive elements 160. The number of passive elements 160 can be determined by the length of the edges 151, 156 of the plates 144, 146 which are to be secured together by the latching means 142. In the present example, two passive elements 160 are illustrated, although one or more may be utilized as required. The set of elements 152 also includes an active element 162 and a pair of passive elements 164, spaced therefrom along the edge 156 corresponding to the spacing of the active and passive elements 158 and 160.

The elements 150, 152 are each L-shaped and have an upstanding portion 166 extending perpendicular to the respective edge of its plate 144, 146 and a laterally extending portion 168 extending in the direction along the edge 151, 156 of its respective plate 144, 146. It is noted that the lateral portion 168 of the active element 158 of the elements 150 extends downwardly in the opposite direction to the lateral portions 168 of its passive elements 160. Conversly, the lateral portion 168 of the active element 162 of the set of elements 152 extends upwardly towards the lateral portions 168 of its passive elements 164.

In FIG. 11, the latching means 142 is illustrated in its engaged condition firmly and hingedly securing together in edge to edge relationship the plates 144 and 146, while the latching means 142′ is illustrated in its disengaged condition and in a process of being engaged for securing together the plates 146 and 148 along their respective edges 170 and 172. The plates 146, 148 are first positioned in edge to edge relationship as shown in FIG. 1. The plate 146 and its elements 150′ are provided with opposite surfaces 174 and 176. Similarly, the plate 148 and its projecting elements 152′ are provided with opposite surfaces 178 and 180. As illustrated, the surface 174 of the passive elements 160′ is positioned opposite or proximate to the surface 178 of the plate 148, while the surface 180 of the passive elements 164′ are positioned opposite or proximate to the surface 176 of the plate 146. The active element 168′ of the set of elements 150′ is pivoted about the hinge connection provided by the score lines 180 to an upstanding position perpendicular to the surface 176 of its place 146, while the active element 162′ of the set of elements 152′ is pivoted perpendicular to the surface 178 of its plate 148. The plate 148 is moved downwardly in the direction of the arrow 182 with respect to the plate 146. This results in the interengagement of the passive elements 160′ with their complentary passive elements 164′ of the respective sets of elements 150′ and 152′. This engaged relationship is clearly shown in FIG. 12, in which the slits 184 formed between the lateral portions 168 of each of the elements 160′ and 164′ and the edge 170, 172 of its plate 146, 148, are interengaged by the opposing element. The active elements 158′ and 162′ are also moved with respect to each other so that their surfaces 174 and 180 are opposite and proximate to each other, as also clearly shown in FIG. 12. In this relationship the lateral portions 168 of the elements 158′, 162′ which are hingedly secured with the upstanding portion of their elements are positioned substantially opposite to each other in their disengaged condition. To engage the active elements, the elements are moved about the score lines 181 in the opposite directions indicated by the arrows 190, 192 in FIG. 13 towards their extending positions in the planes of their respective plates 146, 148. This causes the movemennt of the hinged lateral portions 168′ of the elements 158′, 162′ to pivot about their hinges as also illustrated in FIG. 13. When the elements 158′ and 162′ have been sufficiently displaced, the lateral portions 168′ clear each other and assume their aligned positions with respect to their upstanding portions as illustrated in FIG. 11 by the active elements 158 and 162 of the engaged latching means 142. FIG. 14 is a sectional view taken on line 14—14 of FIG. 11 of a pair of engaged elements 150, 152 illustrating the interlocking relationship.

The latching means 142 is disengaged by performing the above steps in the opposite order, namely disengaging the active elements after which the sheets are moved with respect to each other to disengage the passive elements. By the means illustrated, one or more passive elements positioned along extended edges of a body may be engaged by a simple movement of one body with respect to the other along opposing edges, after which the latching means 142 may be engaged to firmly secure and prevent lateral movement between the bodies by engaging the pair of opposed active elements.

Thus while only a few representative embodiments of the invention disclosed herein have been described in detail, there will be obvious to those skilled in the art, many modifications and variations thereof accomplishing the foregoing objects and realizing many or all of the advantages but which yet do not depart essentially from the spirit of the invention.

What is claimed is:

1. A latching means for securing together a pair of members comprising a first member and a second member, said first member having a first pair of elements extending substantially along the plane of the first member while said second member has a second pair of elements extending substantially along the plane of the second member, each of said elements having first and second sides, each of said first elements being positionable with its first side opposite to the first side of a respective one of said second elements for assuming its disengaged condition and alternatively with its second side opposite to the second side of its respective second element to assume its engaged condition, said first elements being spaced apart and extending in the directions toward each other while the second elements extend in the directions away from each other, at least one of said first elements having a hinged portion movable about an axis substantially perpendicular to said extending directions of said first elements while at least one of said second elements has a hinged portion movable about an axis substantially parallel to the axis of the hinged portion of said first elements which is positioned opposite to said first element with the hinged portion, said first and second elements being movable with respect to each other and by actuation of the hinged portions of said elements about their said axes the second elements pass substantially between and beyond the first elements and thereby being positionable to have the second sides of said elements opposite to each other to place the latching means in its engaged condition.

2. The latching means of claim 1 in which the first and second members have opposing end edges, said first and second elements are L-shaped and respectively project from the edges of said first and second members, said first elements each have a hinged portion movable about an axis which is substantially perpendicular to the edge of the first member and extending toward its other element in a direction along the edge of its body while each of the second elements has a hinged portion movable about an axis which is substantially perpendicular to the edge of the second member and extending away from its other element in a direction along the edge of its body, each of the first elements being positionable opposite to a respective one of the second elements with the first sides of the elements opposite to each other in their disengaged condition, said elements being movable past each other by actuation of the hinged portions of said first and second elements about their respective axes for positioning the second sides of said elements opposite to each other and placing the latching means in its engaged condition.

3. The latching means of claim 2 in which the second pair of L-shaped elements is provided by a common upstanding portion projecting from the edge of its said member and a pair of hinged portions on opposite sides of the upstanding portion extending away from each other in a direction along the edge of its member.

4. The latching means of claim 2 in which at least one pair of said first and second elements are hingedly secured along the edge of the member from which they projects for movement about an axis which is in a direction along the edge of their member.

5. The latching means of claim 2 in which the members are sheets of material and the L-shaped elements and sheets are composed of a flexible plastic material with the hinges of the hinged portions being provided along score lines.

6. The latching means of claim 4 in which said members are sheets and said elements are integral with their respective sheets and composed of a flexible plastic material having score lines thereon, and the hinges of said elements and their hinged portions are provided along score lines in said plastic material.

7. The latching means of claim 3 in which the second pair of elements has a T-shaped configuration, and the space between the first pair of elements and the sheet from which the elements project has an inverted T-shaped configuration with its horizontal portion along the edge of its sheet extending below the hinged portion of said first elements.

8. The latching means of claim 7 in which the hinged portions of the first and second elements are each respectively secured for hinged movement about an axis which is substantially perpendicular to the edge of its sheet, the axes of said first pair of elements being inclined away from each other in the direction away from the edge of its member while the axes of the second pair of elements being inclined toward each other in the direction away from the edge of its member, at least one pair of said first and second pairs of elements is hingedly secured along the edge of the member from which it projects for movement about an axis which is in a direction along the edge of its member.

9. The latching means of claim 8 in which said members are sheets of material and said elements are integral with their respective sheets and composed of a flexible plastic material, the hinges of said elements and their hinged portions being provided along score lines in said plastic material.

10. The latching means of claim 1 in which the first and second pairs of elements each include an active element and an inactive element, the first and second active elements each have a hinged portion and are positionable opposite to each other, the first and second passive elements are slidable for interconnecting and engaging each other with their second sides opposite to each other while positioning the first sides of said active elements opposite to each other in their disengaged condition, said first and second active elements being movable past each other by actuation of their hinged portions for positioning the second sides of said elements opposite to each other and placing the active elements in their engaged condition, whereby the first and second elements are locked in their engaged conditions and said pair of members are secured together.

11. The latching means of claim 10 in which the first and second bodies have opposing end edges, said first and second elements are each L-shaped having an upstanding portion projecting respectively from the edges of said first and second members and a lateral portion extending in a direction along the edge of its member, the lateral portions of said first and second passive elements extending in opposite directions for slidably interconnecting and engaging each other, the lateral portions of said active elements being hinged with their upstanding portions and positioned opposite to the upstanding portions of their respective opposing active elements with their first sides opposite to each other in the disengaged condition, said first and second active elements being movable past each other by actuation of their hinged lateral portions positioning the lateral portions opposite to the upstanding portions of their respective opposing active elements with their second sides opposite to each other placing the active elements in their engaged condition.

12. The latching means of claim 11 which includes a plurality of passive L-shaped elements projecting from the edge of said first member, and a second plurality of passive L-shaped element projecting from the edge of the second member with each being positionable opposite to a respective one of said first passive elements for engagement therewith, each of said first passive elements having a portion extending in one direction along the edge of its member while each of said second passive elements has a portion extending in the direction along the edge of its member which is opposite to the direction of the first passive elements for slidably interconnecting and engaging with the first elements, said first active L-shaped element projecting from the edge of said first member with its hinged lateral portion extending in a direction along the edge of its sheet which is opposite to the direction of extension of the portions of said first passive elements, said second active L-shaped element projecting from the edge of said second member with its hinged lateral portion extending in a direction along the edge of its member which is in a direction opposite to the direction of extension of the portions of said second passive elements, the first and second passive elements being concurrently engaged by their slidable movement in the direction along the edges of said members and said active elements thereafter being movable to their engaged condition for placing the latching means in its engaged condition.

13. The latching means of claim 12 in which the hinged portions of said first and second active elements are secured for hinged movement about respective axes which are each substantially perpendicular to the edge of its respective member.

14. The latching means of claim 13 in which at least one of said active elements is hingedly secured along the edge of its member from which it extends for movement about an axis which is in a direction along the edge of its member.

15. The latching means of claim 14 in which the members are sheets of material, and said elements are integral with their respective sheets.

16. The latching means of claim 15 in which said elements and sheets are composed of a flexible plastic material having score lines thereon, the hinges of said elements and their hinged portions being provided along score lines in said plastic material.

17. The latching means of claim 1 in which said first member has an opening therein and said first pair of elements extend into said opening in the directions toward each other, and said second pair of elements project from said second member, the first sides of the first elements being positionable opposite to the first sides of the second elements in their disengaged condition and the second elements being movable through the opening of said first member by actuation of the hinged portions of said elements for placing the second sides of the elements opposite to each other for placing the latching means in its engaged condition.

18. The latching means of claim 17 in which the second pair of elements has a T-shaped configuration and the opening in said first member is bordered by said first pair of elements to provide an inverted T-shaped configuration.

19. The latching means of claim 17 in which said first elements are hingedly secured with said first member, said second member has an end edge, said second pair of elements are L-shaped and respectively project from the edge of its second member and each have a hinged portion extending away from its other element in the direction along the edge of its member, said elements being movable past each other by actuation of the hinged portions of said first and second elements for positioning the second sides of said elements opposite to each other and placing the latching means in its engaged condition.

20. The latching means of claim 19 in which the second pair of L-shaped elements is provided by a common upstanding portion projecting from the edge of its said member and a pair of hinged portions on opposite sides of the upstanding portion extending away from each other in a direction along the edge of its member.

21. The latching means of claim 19 in which the hinged portions of said first and second elements are secured for hinged movement about respective parallel axes, the axes of the hinged portions of said second elements being substantially perpendicular to the edge of its member.

22. The latching means of claim 21 in which the second elements are hingedly secured along the edge of the member from which it projects for movement about an axis which is in a direction along the edge of its member.

23. The latching means of claim 17 in which the members are sheets of material and the elements and sheets are composed of a flexible plastic material with the hinges of the hinged portions being provided along score lines.

24. The latching means of claim 22 in which said members are sheets and said elements are integral with their respective sheets and composed of a flexible plastic material having score lines thereon, and the hinges of said elements and their hinged portions are provided along score lines on said plastic material.

25. The latching means of claim 24 in which the second pair of elements has a T-shaped configuration and the opening in said first member is bordered by said first pair of elements to provide an inverted T-shaped configuration.

26. The latching means of claim 17 in which said first member has a plurality of openings therein, each opening has a pair of said first elements extending into it in a direction toward the other, the second elements being positionable with their first sides opposite to the first sides of a selected pair of said first elements in their disengaged condition, the second elements being movable through the opening of said selected pair of first elements in said first member by actuation of the hinged portions of said elements for placing the second sides of said selected first elements and said second elements opposite to each other for placing the latching means in its engaged condition.

27. The latching means of claim 26 which includes an elongated flexible band of material providing the first and second members at its end portions, said members and elements are integral and composed of a flexible plastic material having score lines thereon, and the hinges of said elements and their hinged portion are provided along score lines in said plastic material, said openings in said first body being spaced along said band so that said second member may be secured at a selected location therealong.

28. The latching means of claim 27 in which said first member is provided with handle means at its end, and the second pair of elements has a T-shaped configuration and the openings in said first member are bordered by their respective first pairs of elements to provide an inverted T-shaped configuration.

29. The latching means of claim 28 in which said first elements are hingedly secured with said first member, said second member has an end edge with said second pair of elements projecting therefrom, each of said second elements have a hinged portion extending away from its other element in a direction along the edge of its member, and said second elements are hingedly secured along, the edge of the member from which it projects for movement about an axis which is in a direction along the edge of its member.

* * * * *